US011073318B2

(12) United States Patent
Albets Chico et al.

(10) Patent No.: US 11,073,318 B2
(45) Date of Patent: Jul. 27, 2021

(54) ADAPTIVE CONTROL METHOD FOR REFRIGERATION SYSTEMS

(71) Applicants: UNIVERSITAT DE LLEIDA, Lleida (ES); AKO ELECTROMECANICA S.A.L., Sant Pere de Ribes (ES)

(72) Inventors: Xavier Albets Chico, Sallent (ES); Pere Moreno Argiles, Lleida (ES); Miguel Angel González Sánchez, Sant Andreu De la Barca (ES); Luisa Fernanda Cabeza Fabra, Lleida (ES); Gabriel Zsembinszki, Barcelona (ES); Jose Miguel Maldonado Jimenez, Saragossa (ES); Alvaro de Gracia Cuesta, Lleida (ES)

(73) Assignees: Universitat de Lleida, Lleida (ES); Ako Electromecanica S.A.L., Sant Pere de Ribes (ES)

( * ) Notice: Subject to any disclaimer, the term of this patent is extended or adjusted under 35 U.S.C. 154(b) by 28 days.

(21) Appl. No.: 16/498,934

(22) PCT Filed: Mar. 27, 2018

(86) PCT No.: PCT/ES2018/070246
§ 371 (c)(1),
(2) Date: Sep. 27, 2019

(87) PCT Pub. No.: WO2018/178465
PCT Pub. Date: Oct. 4, 2018

(65) Prior Publication Data

US 2020/0049393 A1 Feb. 13, 2020

(30) Foreign Application Priority Data

Mar. 28, 2017 (WO) ..... PCT/ES2017/070178

(51) Int. Cl.
*F25B 47/02* (2006.01)
*F25B 49/00* (2006.01)
(Continued)

(52) U.S. Cl.
CPC ..... *F25B 49/00* (2013.01); *F24F 11/41* (2018.01); *F25D 17/06* (2013.01);
(Continued)

(58) Field of Classification Search
CPC ..... F25B 47/02; F25B 2700/11; F24F 11/41; F24F 11/42; F24F 11/43; F25D 21/002;
(Continued)

(56) References Cited

U.S. PATENT DOCUMENTS 4,949,548 A 8/1990 Meyer
5,490,394 A 2/1996 Marques et al.
(Continued)

FOREIGN PATENT DOCUMENTS

EP 3534095 A1 4/2019

OTHER PUBLICATIONS da Silva et al., "Experimental study of frost accumulation on fan-supplied tube-fin evaporators," Applied Thermal Engineering, vol. 31, pp. 1013-1020 (2011).
(Continued)

*Primary Examiner* — Jonathan Bradford
(74) *Attorney, Agent, or Firm* — Jenkins, Wilson, Taylor & Hunt, P.A.

(57) ABSTRACT

Provided is a method for adaptive control of a refrigeration system, the method including calculating a Number of Transfer Units (NTU) rate or an indicator representing the ease of variation of temperature (FVT) of an evaporator of the refrigeration system, to detect a frost level in the evaporator, to define the most suitable defrosting time, the energization of the drainage resistors and the adaptive man-
(Continued)

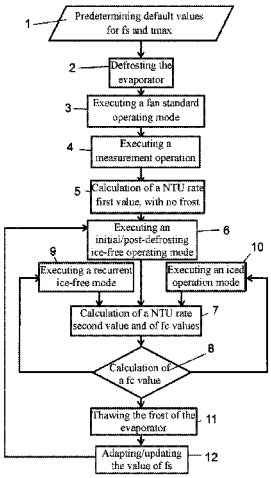

agement of the evaporator fan combining different operating modes, including an ice-free mode that uses only the cooling capacity of the refrigerant, and different modes with ice, which take advantage of the latent heat stored in the ice to save energy, depending on the frost level in the evaporator.

9 Claims, 1 Drawing Sheet

(51) Int. Cl.
*F25D 17/06* (2006.01)
*F24F 11/41* (2018.01)
*F25D 21/04* (2006.01)

(52) U.S. Cl.
CPC ... *F25B 2500/19* (2013.01); *F25B 2600/0251* (2013.01); *F25B 2600/112* (2013.01); *F25B 2700/2117* (2013.01); *F25D 21/04* (2013.01)

(58) Field of Classification Search
CPC ..... F25D 21/004; F25D 21/006; F25D 21/02; F25D 21/06
See application file for complete search history.

(56) References Cited

U.S. PATENT DOCUMENTS 5,564,281 A * 10/1996 Calton ..... F24F 12/003 62/90
6,145,588 A * 11/2000 Martin ..... F24F 3/147 165/133
2005/0132730 A1 6/2005 Lim et al.
2007/0204635 A1 9/2007 Tanaka et al.
2010/0106302 A1 4/2010 Thogersen et al.

OTHER PUBLICATIONS

Lawrence et al., "Refrigerant flow instability as a means to predict the need for defrosting the evaporator in a retail display freezer," International Journal of Refrigeration vol. 31, pp. 107-112 (2008).
Melo et al., "An experimental study on defrost heaters applied to frost-free household refrigerators," Applied Thermal Engineering, vol. 51, pp. 239-245 (2013).
Extended European Search Report and Opinion for EP 18 77 6380 dated Sep. 14, 2020.
International Preliminary Report on Patentability corresponding to International Patent Application No. PCT/ES2018/070246 dated Oct. 1, 2019.
International Search Report corresponding to International Patent Application No. PCT/ES2018/070246 dated Aug. 2, 2018.
Written Opinion corresponding to International Patent Application No. PCT/ES2018/070246 dated Aug. 2, 2018.

* cited by examiner

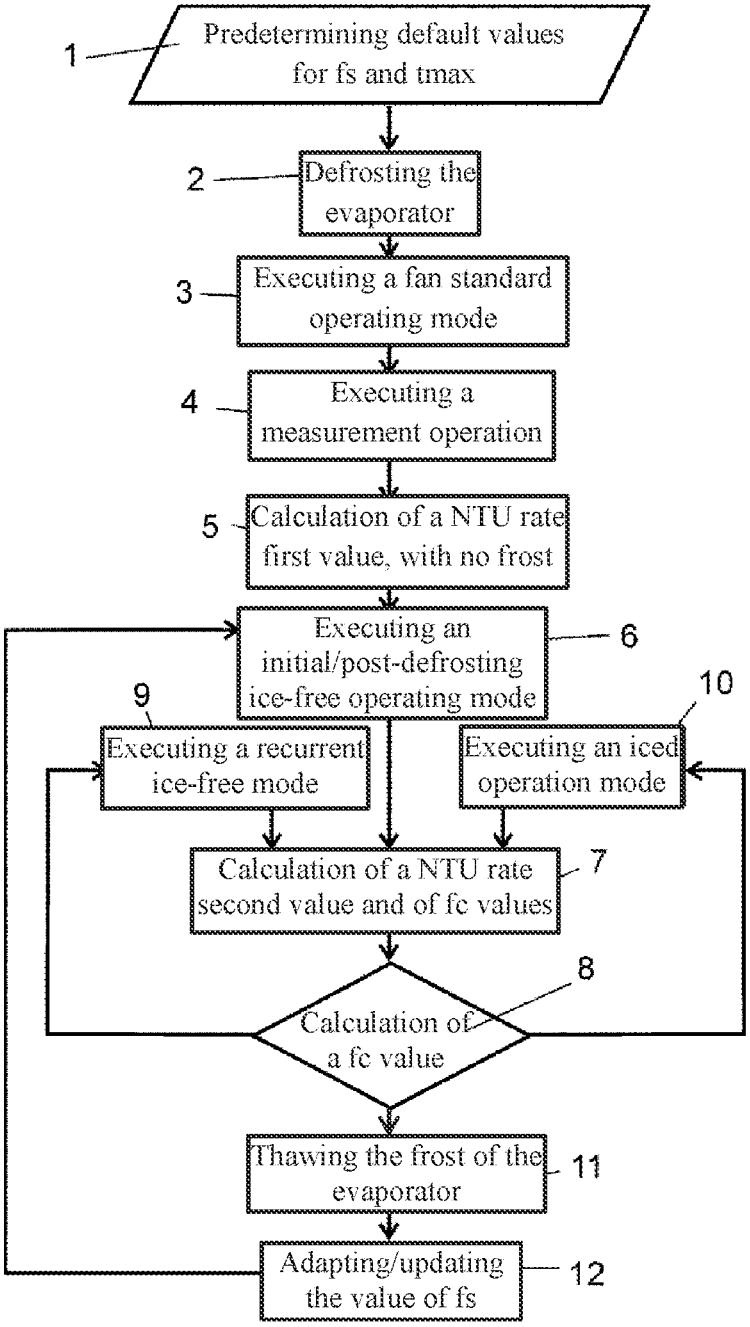
1
Predetermining default values for fs and tmax
2
Defrosting the evaporator
3
Executing a fan standard operating mode
4
Executing a measurement operation
5
Calculation of a NTU rate first value, with no frost
6
Executing an initial/post-defrosting ice-free operating mode
9
Executing a recurrent ice-free mode
10
Executing an iced operation mode
7
Calculation of a NTU rate second value and of fc values
8
Calculation of a fc value
11
Thawing the frost of the evaporator
12
Adapting/updating the value of fs

ADAPTIVE CONTROL METHOD FOR REFRIGERATION SYSTEMS

OBJECT OF THE INVENTION

The invention, as expressed in the title of the present specification, relates to an adaptive control method for refrigeration systems, providing advantages and characteristics, to be described in detail below, entailing an improvement in the current state of the art within the field of application thereof.

More specifically, the object of the invention focuses on a control method for refrigeration systems, this being adaptive on the basis of the level of ice in the evaporator; for this purpose it monitors the refrigeration system and manages the fans and the defrosting processes in accordance with the level of frost in the evaporator, this entailing significant energy savings in the refrigeration system. Furthermore, the level of frost in the evaporator is detected by means of a new calculation method which is valid for any type of system and which is based on an NTU (Number of Transfer Units) rate method.

SCOPE OF THE INVENTION

The scope of the present invention is included in the industrial sector devoted to the manufacture of refrigeration equipment, focusing more specifically on the operation control systems of the same.

BACKGROUND OF THE INVENTION

It is well known that the efficiency of refrigeration systems can be reduced due to the formation of ice (frost) in the heat exchanger (evaporator) circuit of the refrigerated space (evaporator). If this excess frost is not prevented, it may even halt the evaporator [1]. There exist several defrosting methods; some require large amounts of power to eliminate said frost [2] as much as 25% of the total power consumption of the refrigeration system [3]. It is known in the sector that a reduction in the frequency of defrosting may improve the performance of the refrigeration system, as its power consumption is reduced.

It is for this reason that in general, defrosting processes should be maintained at a minimum.

Generally, defrosting processes are programmed at particular times, typically every 6 or 8 hours, with no information regarding the state of the evaporator, which causes on the one hand possible unnecessary defrosting processes, and on the other, periods where there is excessive frost.

The evaporator fan may be managed in different ways, depending on the level of frost in the evaporator, in order to reduce the power consumption of the refrigeration system [5].

In view of the above, the object of the present invention is to develop an improved control method for refrigeration systems, based firstly on a new method for the detection of the level of frost in the evaporator, and secondly on the adaptive management of the evaporator fan so that it may combine different operating modes, and finally, an adaptive criterion to establish the most appropriate defrosting time.

It should be mentioned that said new method for the detection of the level of frost is based on the well-known NTU (Number of Transfer Units) method, used to calculate the heat transfer rate in heat exchangers (particularly upstream heat exchangers) when there is not sufficient information to calculate the logarithmic mean temperature difference (LMTD). In the analysis of the heat exchanger, if the inlet and outlet temperatures of the fluid are specified or can be determined by the simple energy balance, said LMTD method may be used; however, when these temperatures are not available, the NTU method is used.

Additionally, and as a reference to the current state of the art, it should be noted that, although operation control systems for the fans in refrigeration equipment for the optimisation of their operation are known, at least by the applicant, the existence of a method presenting similar or identical characteristics to those advocated herein, as claimed, is unknown.

In this sense, the existence is known of documents EP0328152 of 1992 and U.S. Pat. No. 4,949,548 of 1990, [5, 6] referring to a patent relating to the control of evaporator fans in such a way that the cooling capacity stored in the ice in the evaporator is used, by melting the same and ensuring that the cold is effectively transferred to the refrigerated space; however, the method employed presents significant differences. Specifically, in said document a control based on the temperature difference between evaporator and refrigerated space is used to quantify the level of frost in the evaporator and thus to programme (decide) the commencement of the defrosting process. This approach to the problem is valid, although its application is limited solely to self-contained refrigeration systems (that is, with a condenser unit devoted to the evaporator in question).

Likewise, in patent application US2005/0132730 [7] the method ε—NTU is proposed for the management of the fan of a commercial refrigerator.

In the present invention, to be described in the sections below and whose scope of protection is defined in the attached claims, the quantification method (NTU-rate) is different from those proposed in [5, 6, 7], and specifically enables said control to be valid for both self-contained systems and for those featuring centralised condenser units formed by racks of multiple compressors; this representing a significant advantage.

REFERENCES

1. Claudio Melo Fernando T. Knabben, Paula V. Pereira. An experimental study on defrost heaters applied to frost-free household refrigerators. Applied Thermal Engineering 51 (2013) 239-245.
2. J. M. W. Lawrence, J. A. Evans. Refrigerant flow instability as a means to predict the need for defrosting the evaporator in a retail display freezer cabinet. International Journal of Refrigeration 31 (2008) 107-112.
3. Kazachi G. Project progress meeting in discussion of display case warm liquid defrosting test at EPA. Raleigh: 2001.
4. Diogo L. da Silva, Christian J. L. Hermes, Claudio Melo. Experimental study of frost accumulation on fan-supplied tube-fin evaporators. Applied Thermal Engineering 31 (2011) 1013-1020.
5. Friedhelm Meyer, (1990). Process for controlling the operation of a refrigerating unit. U.S. Pat. No. 4,949,548.
6. Friedhelm Meyer, (1992). Verfahren zum Steuem des Betriebs eines Kühlaggregats. EP0328152B1.
7. Lim Hyoung K et al. Apparatus and method for controlling operation of blower fan of refrigerator. US2005/0132730.

DESCRIPTION OF THE INVENTION

The adaptive control method for refrigeration systems proposed by the invention is therefore configured as an innovation within its scope of application, the characterising details distinguishing the same being appropriately included in the final claims accompanying the present description.

As has been mentioned above, the invention proposes an adaptive control method for refrigeration systems based on the level of ice in the evaporator, which monitors the refrigeration system and manages the fans and the defrosting processes in accordance with the level of frost in the evaporator, conferring significant energy savings on the refrigeration system, comprising essentially a new method for the detection of the level of frost in the evaporator, the adaptive management of the evaporator fan which intelligently combines different operating modes, and finally, an adaptive criterion to decide on the most appropriate time for defrosting.

Specifically, the level of frost in the evaporator is detected by means of a new method for calculating the NTU rate which, advantageously, is valid for any type of system.

The control method therefore combines different management modes of the evaporator fan in accordance with the level of frost in the evaporator, which is in turn determined by said NTU rate method, causing the refrigeration system to operate in different operating modes:

- Ice-free mode: Solely the refrigeration capacity of the coolant is employed.
- Measurement mode: This mode enables a precise NTU rate measurement.
- Different iced modes: The iced modes employ the latent heat stored in the ice to provide energy savings, depending on the level of frost in the evaporator.

The adaptive control method of the present invention, according to a first aspect, comprises the performance of the aforementioned detection of the level of frost by means of the obtaining of a dimensionless coefficient fc of the relative level of frost in the evaporator and the monitoring of the temporal evolution of the same, where the method comprises the obtaining of said dimensionless coefficient fc of the relative level of frost in the evaporator:

- from the calculation of a first value or reference value of the NTU rate, performed when the evaporator is dry at the commencement, with no frost, and
- from the calculation of second values of the NTU rate, when the refrigeration system is in operation during one of said iced modes of fan management, performing said calculation repeatedly over time, with an inconstant frequency of repetitions which varies depending on the performance of the evaporator or on the level of ice in the same;

where said dimensionless coefficient fc of the relative level of frost in the evaporator relates, in a comparative manner, the second values with the first value of the NTU rate.

In other words, the adaptive control method of the invention, in accordance with said first aspect, contemplates the calculation of the NTU rate at the commencement, when the evaporator is dry (with no frost). Said level is used as a reference. When the refrigeration system is in operation, the adaptive control method contemplates the repeated calculation of the NTU rate, with a variable frequency of repetitions (depending in turn on the output of the evaporator or the level of ice therein), and their comparison with the reference. The value obtained is a dimensionless coefficient (fc) reporting on the level of frost in the evaporator.

Depending on the fc coefficient, the strategy (mode) of operation of the evaporator fan is decided, and it is decided whether a defrosting process is required in real time.

To this end, in accordance with an embodiment, the fc coefficient is compared with the value of a dimensionless reference performance coefficient fs indicating that a defrost is required, which in turn adapts, subsequent to said comparison of fc and fs values, being updated in accordance with the time required to perform the defrost on implementing one of said iced operation modes on the basis of said value of fc compared, the first fs being a default value. Thus, the value of defrost activation is adapted until a level of frost is achieved in the evaporator which enables the obtaining of the optimal (most efficient) level of operation of the refrigeration system.

A more detailed explanation is provided below of an embodiment of the first aspect of the present invention, concerning the new method of calculating the NTU rate employed to detect the level of frost in the evaporator; a method which, advantageously, is valid for any type of system.

Specifically, the calculation performed in accordance with said embodiment consists of the relative assessment of the heat flow lost by the air in the refrigerated chamber at the moment when coolant enters the evaporator. According to the classic ε-NTU method, a mode of quantifying the heat flow lost by the air in the chamber obeys equation 1:

$$q=\varepsilon\cdot Cp(\text{air})\cdot\dot{m}(\text{air})\cdot(T_{air}-T_{evap}) \tag{1}$$

Where q is the heat flow absorbed by the evaporator, ε is the efficiency of the heat exchanger, Cp(air) is the specific heat of the air, $\dot{m}$(air) is the mass flow of air crossing the fins of the evaporator (driven by the evaporator fan) and ($T_{air}$−$T_{evap}$) is the temperature difference between the air in the refrigerator chamber and the evaporator, which is assumed to be constant throughout the evaporator (as the coolant is evaporating).

The heat flow "stolen" by the evaporator from the air in the refrigerator chamber is constant, as:

- the air in the refrigerator chamber is at a controlled temperature and therefore has a constant [Cp(air)].
- The air flowrate responds to the evaporator fan, which has a constant flowrate [m(air)].
- The flowrate and the enthalpy leap of the coolant in the evaporator are adjusted by means of the control and power of the compression (constant) and expansion; they are therefore constant.
- The temperature of the evaporator, where the coolant changes phase, is constant throughout the entire evaporator.

Therefore, when there is no frost in the evaporator, its exchange of heat with the air in the chamber responds to a characteristic performance (ε dry). Conversely, when the evaporator has a particular level of frost, the exchange of heat responds to a different performance (ε ice). The performance drops simply because the frost represents a thermal insulant for the exchange of heat. However, in both cases, the exchange of heat is the same.

Therefore:

$$q_{dry}=\varepsilon_{dry}\cdot Cp(\text{air})\cdot\dot{m}(\text{air})\cdot(T_{air}-T_{evap})^{dry} \tag{2}$$

$$q_{ice}=\varepsilon_{ice}\cdot Cp(\text{air})\cdot\dot{m}(\text{air})\cdot(T_{air}-T_{evap})^{ice} \tag{3}$$

If the equations are equalised (due to the fact that, as has been mentioned above, the heat flow is constant with and without frost) it may be observed that:

$$\varepsilon_{dry}\cdot(T_{air}-T_{evap})^{dry}=\varepsilon_{ice}\cdot(T_{air}-T_{evap})^{ice} \tag{4}$$

From the analysis of this equation it may be observed that the gradient between air in the chamber and evaporator changes linearly with the relationship between efficiencies of the heat exchanger.

By means of the precise measurement of both temperatures ($T_{air}$ and $T_{evap}$) under frostless (dry) and frosted (ice) conditions, the loss of performance of the evaporator may be determined.

For this reason, to implement the method of the present invention, a system featuring two temperature probes is used:

Chamber probe: measures the temperature of the air in the chamber (and thus regulates the cooling necessary to maintain the chamber at the desired temperature).

Evaporator probe: measures the evaporation temperature of the evaporator, in contact with the piping where the coolant expands and evaporates.

Knowing that the exchange efficiency is related to the NTU for evaporators according to:

$$\varepsilon=1-e^{-NTU} \tag{5}$$

Where NTU is $$NTU = \frac{UA}{(\dot{m}\,Cp)\,\text{air}} \tag{6}$$

Where U is the global heat transfer coefficient and A is the area of heat transfer, ($T_{air}-T_{evap}$) may be related to UA. Therefore, on measuring the temperature differences between the refrigerator chamber and the evaporator ($T_{air}-T_{evap}$), a relative efficiency under dry conditions is estimated which, following the mathematical relationships specified by the method, imply a $UA_{dry}$.

Under frosted conditions, the same measurements generate a $UA_{ice}$ value.

By means of the relationship $UA_{ice}/UA_{dry}$ the aforementioned fc coefficient is determined; this is the relative level of frost and which enables the making of decisions regarding the management of the fan and the need to defrost.

As has been stated above herein, the calculation of the level of ice is performed at the commencement, precisely when a defrosting has been performed, and it is ensured that the evaporator is completely free from frost and under the stabilized thermal conditions. In accordance with the embodiment explained with regard to equations (1-6) this value, that is, the $UA_{dry}$ value, is the reference (or value identified above as first value or reference value of the NTU rate). As the evaporator operates, the calculation of the level of frost, that is, the $UA_{ice}$ value (identified above as the second NTU rate value) is performed periodically, and the value calculated is divided with regard to the reference ($UA_{dry}$, frost-free). The division of both factors provides the fc value. From this explanation it may be deduced the value of fc=1 for the reference $UA_{dry}$.

With regard to the frequency of calculation for the production of the $UA_{ice}$ value, this being that of the repetitions of said calculation, for one embodiment this is typically of 4 hours (one calculation every 4 hours), although this is parametrizable (the user may select a value between 2 and 6 hours). As the fc drops, approaching the fs value (the limit value indicating the need for defrosting), the frequency drops linearly to ensure that the evaporator is not blocked by frost; for example passing from 4 hours between calculations to 3 hours, and finally to 2 hours when is very close to fs.

With regard to what is referred above as the dimensionless reference performance coefficient fs, this may be understood to be a coefficient whose value indicates a lower limit for the fc value, in such a way that if the fc value drops until it reaches said lower limit, it is determined that a defrost is required. Specifically, for the embodiment detailed with reference to equations (1-6), this fs value (always between 0 and 1) represents the maximum tolerated reduction relative to $UA_{dry}$ (frost-free) of the $UA_{ice}$ (with a certain level of frost). Once this is reached (or surpassed downwardly, that is when fc<=fs), a defrost is commenced. By default, its value is relatively high (for example, 0.6) to prevent any blocking in the first iterations of the controller. As defrosts are performed, the times necessary for the melting of the frost in the equipment are measured. The greater the amount of frost in the evaporator, the longer the defrosting time. The fs coefficient is updated until defrosts of the desired length are achieved, by means of a defrosting strategy coefficient. Thus, the coefficient will commence, for example, at fs=0.6 (which means that the minimum acceptable $UA_{ice}$ value in comparison with the $UA_{dry}$ value is 60%). If said defrost entails a shorter defrosting time than desired, fs will be updated to, for example, 0.5, and at the next defrost it will again be assessed whether the amount of frost is equal to that desired, by means of the measurement of the defrosting time employed; and so on until reaching a fs value stabilized at the maximum amount of frost which is acceptable to the user.

Preferably, the method contemplates the existence of a safety indicator which can halt the refrigeration system and activate the defrosting process, in the event that this might be the reason for a malfunction.

Additionally, and thanks to the capacity of predicting the time for defrosting on the basis of the temporal evolution of the fc coefficient, the method contemplates that the heating system for drainage of the evaporator should only be activated when necessary (prior to defrosting) while it is maintained inactive during the periods where defrosting is not in operation or is not foreseen in the short term, which increases the potential savings which this adaptive method confers to the refrigeration system.

The principal advantages and innovative characteristics provided by the method of the invention are:

The NTU rate to quantify the level of frost in the evaporator.

The strategy for the fans (mode of operation) depends on the level of frost in the evaporator. There exist several modes of operation, depending on the level of frost.

The defrosting process is activated depending on an NTU rate in the evaporator, which reduces the number of defrosts to be performed.

The relative level of frost (NTU rate) to activate the defrost adapts to the duration of the defrosting process, which may also be related to the time during which the refrigerated space is out of range.

On the basis of the temporal evolution of the NTU rate, the drainage heating system is activated only when necessary, thus increasing the potential energy savings in the system.

In short, the method comprises the detection of the level of frost in the evaporator by means of a calculation method of the NTU rate, which enables the definition of a) the most appropriate time for defrosting, b) the energisation of the drainage resistances, and c) the adaptive management of the evaporator fan combining different modes of operation, comprising an ice-free mode where solely the refrigeration capacity of the coolant is employed, and different iced modes where the latent heat stored in the ice is employed to provide energy savings, depending on the level of frost in the evaporator where, for the calculation of the NTU rate it uses as a reference the evaporator when it is dry, at the commencement, and when the refrigeration system is in operation, it performs the calculation of the NTU rate with a specific, precise fan management mode, carried out with a non-constant, but variable frequency, which varies depending on the performance of the evaporator or on the level of ice therein, and its comparison with the aforementioned reference.

In a second aspect, the present invention relates to an adaptive control method for refrigeration systems which, being of the type which manages the fans in accordance with the level of frost in the evaporator, comprises the detection of the level of frost in the evaporator by means of a calculation method alternative to that proposed by the first aspect, or second calculation method, whose scope of protection is to be found defined in claim 8.

Said second method provides an indicator representing the facility to the variation of temperature (FVT) of the evaporator, where the value of said FVT indicator drops with the amount of frost, as the mass of frost increases (greater thermal inertia), and reduces the power of heat transfer to the air (ε or heat exchange efficiency, as seen in the preceding method). The facility to the variation of temperature of the evaporator is calculated according to:

$$FVT = \frac{\text{Te_end} - \text{Te_ini}}{\text{timestep} \cdot \sum \text{abs}((T_{evap} - T_{air}))_i}$$

where (Te_end−Te_ini) is the difference between the temperatures of the evaporator at the end and at the commencement of an evaporator heating (when there is no ingress of coolant into the same, the evaporator, with a ventilation activated, heats up until it reaches practically the temperature of the refrigerator chamber), ($T_{evap}$−$T_{air}$) are the successive samples of thermal gradient between evaporator and chamber which occur during said heating (a process which takes a number of minutes) and which are measured with each timestep (time in seconds between samples), where said factor is used to correct deviations in measurement caused by possible variations in temperature within the chamber.

Similarly to the indicated for the first method, based on E-NTU, from the values of the facility to the variation of temperature FVT of the evaporator under frost-free (dry) conditions, and under conditions with a certain level of frost (ice), the relative level of ice may be obtained by means of the relationship $FVT_{ice}/FVT_{dry}$, represented by the fc coefficient.

The first method, that is, that of the first aspect of the present invention, is used when the evaporator cools the air in the refrigerator chamber by means of the evaporation of the coolant therein. Said value is calculated for a particular moment (generally a few seconds subsequent to the ingress of coolant into the evaporator). Conversely, the second method, this being the second aspect of the invention, is applied when the air in the refrigerator chamber heats the evaporator, with no ingress of coolant, which occurs during a process which is a question of minutes, during which thermal leaps between the air in the refrigerator chamber and the evaporator are averaged.

In view of the above, it is stated that the here described adaptive control method for refrigeration systems represents an innovation of characteristics unknown until now, for the purpose for which is intended; reasons which, in view of its practical utility, endow it with sufficient grounds to obtain the privilege of exclusivity requested.

DESCRIPTION OF THE DRAWINGS

As a complement to the description made herein, and for a better understanding of the characteristics of the invention, a drawing is attached to the present specification as an integral part thereof, wherein, by way of illustration but not limitation, the following is portrayed:

FIG. 1 portrays a flow diagram of the adaptive control method for refrigeration systems which is the object of the present invention, wherein the stages comprised by the method can be observed.

PREFERRED EMBODIMENT OF THE INVENTION

In view of the described and unique FIG. 1, and in accordance with the numbering adopted, it can be seen how the adaptive control method for refrigeration systems of the present invention contemplates the following stages in the order shown:

- A first stage (1) wherein the default value of the fs coefficient is predetermined, as is the maximum defrosting time (tmax), which comprises reasonable values for the defrosting of an evaporator of a refrigeration chamber (between 45 and 5 min). For example, a default value of tmax=18 minutes is assigned, this being parametrizable. The fs coefficient is adjusted until the defrosting time reaches the value of tmax, which is adjustable (parametrizable);
- A second stage (2) where the evaporator is defrosted;
- A third stage (3) where a standard operating mode of the fan is executed, during a pre-set time or a time typical of the normal operation of the regulation (control) of the cooling generation within the refrigeration chamber. Said time is necessary for the stabilisation of temperatures during the start-up of the refrigeration chamber. It is generally set at half an hour, although it is parametrizable;
- A fourth stage (4), where the measurement operation mode is executed, during a pre-set time;
- A fifth stage (5), where the calculation of said first value or reference value of the NTU rate is performed with the evaporator dry, with no frost; a calculation performed at the commencement of the regulation of cooling, subsequent to a defrost and always subsequent to the pre-set time. Thus, it is ensured that the evaporator is frost-free (thanks to the defrost) but the chamber is under the thermal conditions stabilized to its normal application (thanks to the pre-set time);
- A sixth stage (6), where an initial/post-defrosting ice-free operating mode of the refrigeration system is executed, wherein solely the refrigeration capacity of the coolant is used;
- A seventh stage (7), where the calculation of one of the second values of the NTU rate is carried out, and also the obtaining of the values of the fc coefficient of the relative level of frost from said second value and said first value;

An eighth stage (8), where the calculation of the value of said fc coefficient is carried out, with three possible options for the following stage:

A ninth stage (9), where if the evaporator is frost-free, the recurrent ice-free mode is executed; that is, using solely the refrigeration capacity of the coolant; subsequently returning to stage (7) where, once again, the calculation of one of the second values of the NTU rate is carried out, to obtain a new value of the fc coefficient of the relative level of frost;

A tenth stage (10), where if the evaporator has a little frost, the appropriate iced operation mode is executed, depending on the value of said fc coefficient; that is, one of the different iced modes is selected, where the latent heat stored in the ice of the frost is employed to provide energy savings; subsequently returning to stage (7) where, once again, the calculation of one of the second values of the NTU rate is carried out, to obtain the new fc coefficient of the level of frost;

An eleventh stage (11) of thawing the evaporator, should this have excessive frost; and A twelfth stage (12), the performance of which is subject to the performance of the eleventh stage (11), in which the value of the fs coefficient of the level of frost is assessed and, if deemed necessary, its value is adapted/updated, subsequently returning to stage (6) wherein the initial/post-defrosting ice-free fan operating mode is executed once again.

It should be noted that in order to perform said operating stages, the adaptive control method contemplates the input into the system of the following parameters:

Temperature of the evaporator
Temperature of the refrigerated space
Real Time Clock
Compressor ON/OFF signal
Solenoid ON/OFF signal
Defrost ON/OFF signal
Maximum acceptable defrosting time
Initial defrost activation coefficient (fs)
Safety time without defrosting
Hysteresis related to the temperature setpoint of the refrigerated space
Maximum out-of-setpoint acceptable time The nature of the present invention having been sufficiently described, as well as the manner of putting it into practice, it is not considered necessary to make the explanation thereof more extensive for any expert skilled in the art to understand its scope and the advantages to be derived therefrom; it is therefore stated that within its essential nature it may be put into practice in other embodiments which may differ in detail from that indicated by way of an example, embodiments which will be equally covered by the protection which is sought, provided that its fundamental principle is not altered, changed or modified.

The invention claimed is:

1. A method for adaptive control of a refrigeration system and for managing fans of the refrigeration system according to a level of frost in an evaporator of the refrigeration system, the method comprising:

detecting the level of frost in the evaporator using a Number of Transfer Units (NTU) rate calculation method, by obtaining a dimensionless coefficient fc of the relative level of frost in the evaporator and monitoring the temporal evolution of said dimensionless coefficient fc, wherein the obtaining of said dimensionless coefficient fc comprises:

calculating a first value, or reference value, of the NTU rate, when the evaporator is dry at the commencement of a refrigeration cycle, with no frost, calculating second values of the NTU rate, when the refrigeration system is in operation during one of different iced modes of fan management, performing said calculation of second values repeatedly over time, with a non-constant frequency of repetitions which varies depending on the performance of the evaporator or on the level of ice in the same, and obtaining said dimensionless coefficient fc of the relative level of frost in the evaporator by relating, in a comparative manner, the calculated NTU rate second values with the calculated NTU rate first value, and performing an adaptive management of the evaporator fan combining different operating modes, including an ice-free mode; where solely the refrigeration capacity of the coolant is employed, and said different iced modes where the latent heat stored in the ice is employed to provide energy savings, depending on the level of frost detected in the evaporator.

2. The method of claim 1, wherein $fc=UA_{ice}/UA_{dry}$, where U is a global heat transfer coefficient and A is the area of heat transfer, and they are obtained from the calculation of the aforementioned first and second values of the NTU rate, according to the following expression:

$$UA=\mathrm{NTU}\cdot(\dot{m}Cp)\mathrm{air}$$

where $\dot{m}$ is the mass flow of air crossing the fins of the evaporator and Cp is the specific heat of the air, and NTU is obtained from the following expression:

$$\varepsilon=1-e^{-NTU}$$

where ε is the efficiency of the heat exchange and is defined as $\varepsilon_{dry}$ to calculate the first value of the NTU rate and as $\varepsilon_{ice}$ to calculate the second values of the NTU rate, which are in turn related according to the following expression:

$$\varepsilon_{dry}\cdot(T_{air}-T_{evap})^{dry}=\varepsilon_{ice}\cdot(T_{air}-T_{evap})^{ice}$$

where $(T_{air}-T_{evap})^{dry}$ is the temperature difference between the air in the refrigeration chamber and the evaporator when there is no frost/ice in the latter, and $(T_{air}-T_{evap})^{ice}$ is the temperature difference between the air in the refrigeration chamber and the evaporator when there is frost/ice in the latter, and where the method comprises the measurement of the values of said temperatures.

3. The method of claim 1, further comprising, in order to decide on the operating mode and as to whether a defrosting process is necessary to be carried out in real time, comparing the value of the fc coefficient with to a dimensionless reference performance coefficient fs that indicates that a defrosting process is necessary, where said value of fs is adapted, subsequent to said comparison of the values of fc with fs, by updating the same in accordance with the time required for the performance of the defrosting process by implementing one of said iced operating modes on the basis of said fc value compared, the first fs value being a default value.

4. The method of claim 3, wherein the method comprises using a safety indicator to halt the refrigeration system and activate the defrosting process, in the event that a need for defrosting might be the reason for a malfunction.

5. The method of claim 3, further comprising predicting the time for defrosting on the basis of the temporal evolution of the fc coefficient, and activating the heating system for drainage of the evaporator only prior to defrosting, while the heating system for drainage of the evaporator is maintained inactive during the periods where the defrosting process is not in operation or is not foreseen in the short term.

6. The method of claim 3, wherein the method comprises the following stages:

a first stage, comprising predetermining default values for both the fs coefficient and the maximum defrosting time (tmax);

a second stage, comprising defrosting the evaporator;

a third stage, comprising executing a standard operating mode of the fan;

a fourth stage, comprising executing a measurement operation mode;

a fifth stage, comprising performing the calculation of said first value or reference value of the NTU rate with the evaporator dry, with no frost;

a sixth stage, comprising executing an initial/post-defrosting ice-free operating mode of the refrigeration system, using solely the refrigeration capacity of the coolant;

a seventh stage, comprising carrying out the calculation of one of the second values of the NTU rate, and also obtaining the values of the fc coefficient of the relative level of frost from said second value and said first value;

an eighth stage, comprising carrying out the calculation of the value of said fc coefficient, with three possible options for the following stage:

a ninth stage, comprising executing a recurrent ice-free mode; that is, using solely the refrigeration capacity of the coolant; subsequently returning to the seventh stage where, once again, the calculation of one of the second values of the NTU rate is carried out, to obtain a new value for the fc coefficient of the relative level of frost;

a tenth stage, comprising executing the appropriate iced operation mode, depending on the value of said fc coefficient; that is, one of the different iced modes is selected, where the latent heat stored in the ice of the frost is employed to provide energy savings; subsequently returning to the seventh stage where, once again, the calculation of one of the second values of the NTU rate is carried out, to obtain the new fc coefficient of the level of frost;

an eleventh stage, comprising thawing the frost of the evaporator; and a twelfth stage, the performance of which is subject to the performance of the eleventh stage, comprising the adaptation/updating of the value of the fs coefficient of the level of frost, subsequently returning to the sixth stage, wherein the initial/post-defrosting ice-free fan operating mode is executed once again.

7. The method of claim 1, wherein the method comprises obtaining said dimensionless coefficient fc of the relative level of frost in the evaporator when the evaporator is cooling the air within the refrigeration chamber of the refrigeration system via evaporation of the coolant circulating within the same.

8. A method for adaptive control of a refrigeration systems, comprising managing fans of the refrigeration system according to the level of frost in an evaporator of the refrigeration system, the method comprising the detection of the level of frost in the evaporator by a calculation method of a FVT indicator representing the facility to the variation of temperature of the evaporator, according to the following expression:

$$FVT = \frac{\text{Te_end} - \text{Te_ini}}{\text{timestep} \cdot \sum \text{abs}((T_{evap} - T_{air}))_i}$$

where (Te_end−Te_ini) is the difference between the temperatures of the evaporator at the end and at the commencement, respectively, of an evaporator heating process, ($T_{evap}$−$T_{air}$) are the successive samples of the thermal gradient between the temperature of the evaporator $T_{evap}$ and that of the refrigeration chamber of the refrigeration system $T_{air}$, occurring during said heating process, measured with each timestep or time in seconds between thermal gradient samples i.

9. The method of claim 8, wherein the method comprises the performance of said detection of the level of frost by obtaining a dimensionless coefficient fc of the relative level of frost in the evaporator and monitoring of the temporal evolution of the same, where the method comprises obtaining said dimensionless coefficient fc of the relative level of frost in the evaporator from the relationship $FVT_{ice}/FVT_{dry}$, where $FVT_{ice}$ includes the values of the FVT indicator obtained when there is frost in the evaporator, and $FVT_{dry}$ the values of the same when there is no frost in the evaporator.

* * * * *